US009072418B2

(12) United States Patent
Hwang et al.

(10) Patent No.: US 9,072,418 B2
(45) Date of Patent: Jul. 7, 2015

(54) VACUUM CLEANER

(75) Inventors: Geunbae Hwang, Seoul (KR); Kietak Hyun, Seoul (KR); Jaedal Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 891 days.

(21) Appl. No.: 13/302,030

(22) Filed: Nov. 22, 2011

(65) Prior Publication Data

US 2012/0159738 A1 Jun. 28, 2012

(30) Foreign Application Priority Data

Dec. 28, 2010 (KR) ..... 10-2010-0136281

(51) Int. Cl.
*A47L 9/20* (2006.01)
*A47L 9/10* (2006.01)

(52) U.S. Cl.
CPC *A47L 9/102* (2013.01); *A47L 9/108* (2013.01)

(58) Field of Classification Search
CPC ..... A47L 9/02; A47L 9/102; A47L 9/108
USPC ..... 15/347, 352, 353
IPC ..... A47L 9/10, 9/20
See application file for complete search history.

(56) References Cited

U.S. PATENT DOCUMENTS 8,370,992 B2 * 2/2013 Chong et al. ..... 15/352
2012/0011679 A1 * 1/2012 Chong et al. ..... 15/352

FOREIGN PATENT DOCUMENTS

EP 1 839 758 A1 10/2007
FR 2 823 091 A1 10/2002

OTHER PUBLICATIONS

European Search Report dated Jun. 25, 2012 issued in Application No. 11 19 1076.

* cited by examiner

*Primary Examiner* — David Redding
(74) *Attorney, Agent, or Firm* — Ked & Associates, LLP

(57) ABSTRACT

A vacuum cleaner is disclosed. The vacuum cleaner includes a dust separation device provided in a body; a dust collection device connected with the dust separation device; a dust compression part movably provided in the dust collection device, to compress dust by applying a pressure to dust collected in the dust collection device selectively; a liquid accommodation part provided in the dust collection device or the body, to accommodate a predetermined liquid; and a liquid exhaustion part connected with the liquid accommodation part, to exhaust the liquid toward the dust in the dust compression performed by the dust compression part, wherein the liquid exhaustion part comprises an opening/closing member provided therein to control flow of the liquid, and the opening/closing member is transformed by an external force to guide the liquid to be exhausted outside the liquid exhaustion part.

19 Claims, 21 Drawing Sheets

VACUUM CLEANER

CROSS-REFERENCE TO RELATED APPLICATION

This application claims priority under 35 U.S.C. §119 from Korean Application No. 10-2010-0136281 filed Dec. 28, 2010, the subject matter of which is incorporated herein by reference.

BACKGROUND

1. Field

Embodiments may relate to a vacuum cleaner, more particularly, to a vacuum cleaner which is able to soli.

2. Background

Generally, a vacuum cleaner is an electric appliance that filters dust, dirt and foreign matters together with air into a body provided therein, after sucking them by using a vacuum motor mounted in the body.

Such a vacuum cleaner may be classified into a canister type having a suction nozzle in communication with the body via a connection pipe and an upright type having a suction nozzle integrally formed with the body as suction inlet.

The canister type vacuum cleaner out of the two types may include a vacuum cleaner body having a vacuum motor configured to generate a suction force mounted therein, a suction nozzle configured to suck dust and foreign matters scattered on a surface to vacuum-clean by the suction force generated in the body, and a connection pipe configured to connect the body and the suction nozzle with each other.

In other words, once an electric power is applied to the body, the vacuum motor may be driven and the suction force may be generated. The suction force enables the suction nozzle to suck therein the air containing dust and foreign matters scattered on the surface which will be cleaned.

The air containing the dust and foreign matters may be drawn into the body via the connection pipe.

The dust and foreign matters contained in the air sucked into the body may be separated within a dust separation device provided in the body by cyclone theory.

After that, the separated dust and foreign matters may be collected in a dust collection device in communication with the dust separation device and the air having the dust and foreign matters separated there from may be exhausted outside the body.

In the meanwhile, if the dust and foreign matters separated by the dust separation device are accumulating in the dust collection device, a user may detach the dust collection device from the body to throw away the dust and foreign matters.

However, the accumulating dust and foreign matters might be scattered within the dust collection device because of a light weight and they might be scattered when the user throws them away after separating the dust collection device from the body.

SUMMARY

Accordingly, the embodiments may be directed to a vacuum cleaner. To solve the problems, an object of the embodiments may be to provide a vacuum cleaner which can reduce a volume of dust by compressing dust collected in a dust collection device and which can maintain the compressed dust in a state of being solidified by mixing a liquid with the compressed dust, only to perform cleaning of an internal space of the dust collection device.

To achieve these objects and other advantages and in accordance with the purpose of the embodiments, as embodied and broadly described herein, a vacuum cleaner includes a dust separation device provided in a body; a dust collection device connected with the dust separation device; a dust compression part movably provided in the dust collection device, to compress dust by applying a pressure to dust collected in the dust collection device selectively; a liquid accommodation part provided in the dust collection device or the body, to accommodate a predetermined liquid; and a liquid exhaustion part connected with the liquid accommodation part, to exhaust the liquid toward the dust in the dust compression performed by the dust compression part, wherein the liquid exhaustion part comprises an opening/closing member provided therein to control flow of the liquid, and the opening/closing member is transformed by an external force to guide the liquid to be exhausted outside the liquid exhaustion part.

In another aspect of the present invention, a vacuum cleaner includes a vacuum motor; a dust collection device configured to collect dust; a dust compression part provided in the dust collection device, to be able to communicate with the vacuum motor, the dust compression part that is transformable based on change of a pressure generated by the vacuum motor to compress the dust collected in the dust collection device; a liquid accommodation part configured to accommodate a liquid that will be mixed with the dust collected in the dust collection device; and a liquid exhaustion part connected with the liquid accommodation part, with being coupled to a contact area of the dust compression part with the dust, to exhaust the liquid toward the dust while contacting with the compressed dust in the dust compression performed by the dust compression part.

The liquid exhaustion part includes an opening/closing member provided in the liquid exhaustion part to be open selectively during the dust compression to guide flow of the liquid; and a force transmitting device provided in the liquid exhaustion part to be able to contact with the dust, the force transmitting device movable along the contact with the dust compressed in the dust compression to apply a pressure to the opening/closing member.

According to the embodiments, the dust compression part may be movable upward and downward, with expanded or contacted within the dust collection device. Because of that, the dust may be compressed and the volume of the dust may be reduced as much as possible.

The operation of the dust compression part may be enabled by the selective connection between the dust compression part and parts having different pressures from the pressure inside the dust collection device. As a result, the user does not have to perform an auxiliary operation to compress the dust.

Also, the liquid used for compressing and solidifying the dust may be sprayed toward the compressed dust. Because of that, the dust may not blow away advantageously when the user gets rid of the dust from the dust collection device.

The liquid exhaustion part configured to exhaust the liquid used for dust solidification and the liquid accommodation part may be coupled to the dust compression part. Because of that, the vacuum cleaner according to the embodiments may not require an extra space used to install the liquid exhaustion part and the liquid accommodation part, to reduce the size of the body advantageously.

It is to be understood that both the foregoing general description and the following detailed description of the embodiments or arrangements are exemplary and explanatory and are intended to provide further explanation of the embodiments as claimed.

BRIEF DESCRIPTION OF THE DRAWINGS

Arrangements and embodiments may be described in detail with reference to the following drawings in which like reference numerals refer to like elements and wherein:

FIGS. 6(*c*) and 6(*d*) are a perspective view and a side sectional view illustrating the opening/closing member according to the first embodiment, after transformed;

DETAILED DESCRIPTION

As follows, exemplary embodiments will be described in detail in reference to the accompanying drawings.

Reference may now be made in detail to specific embodiments, examples of which may be illustrated in the accompanying drawings. Wherever possible, same reference numbers may be used throughout the drawings to refer to the same or like parts.

Figure 1:
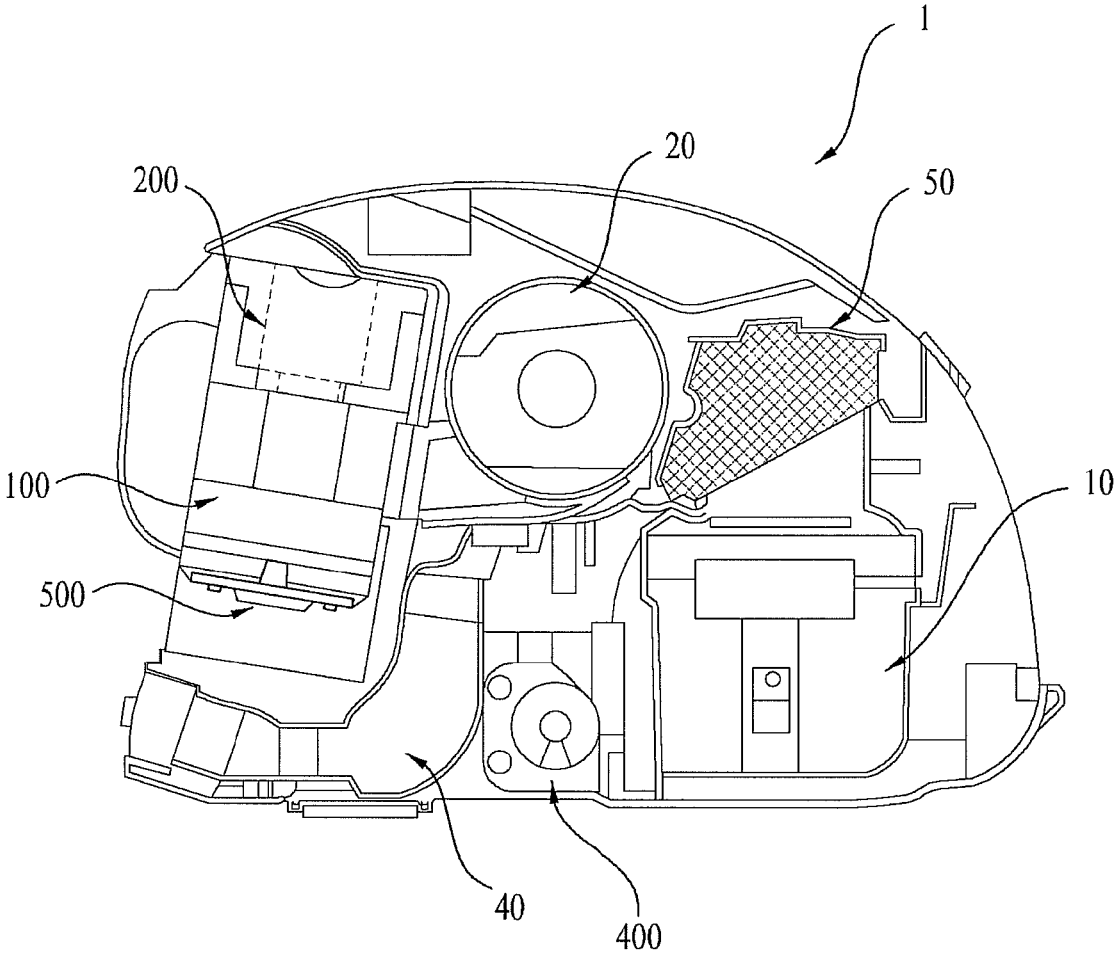
FIG. 1 is a side sectional view illustrating a body of a vacuum cleaner according to an embodiment.

As shown in FIG. 1, a vacuum cleaner may include a suction nozzle (not shown) and a body 1 connected with the suction nozzle.

The body 1 may include a vacuum motor 10 provided therein to form a vacuum suction pressure, a dust separation device 20 arranged in an inlet of the vacuum motor 10, a dust collection device 30 connected with the dust separation device 20 and a guide passage 40 configured to guide dust and air toward the dust separation device 20.

The dust separation device 20 may separate air from dust by using a rotational centrifugal force of the dust based on a cyclone theory.

A filter device 50 may be provided between the dust separation device 20 and the vacuum motor 10. The filter device 50 may filter the air exhausted after separated from the dust in the dust separation device 20.

The dust collection device 30 may be cylindrical-shaped and an end of the dust collection device 30 may be connected with an outer circumferential surface of the dust separation device, to draw the dust rotating in the dust separation device 20.

A dust compression part 100 may be provided in the dust collection device 30 to compress the dust collected in the dust collection device 30, while moving upward and downward.

A liquid accommodation part 200 may be provided in the dust compression part 100 to accommodate a liquid that is capable of solidifying the dust.

A liquid exhaustion part 500 connected with the liquid accommodation part 200 may be provided underneath the dust compression part 100 to exhaust a liquid toward the compressed dust while the dust compression part 100 is compressing the dust.

A switching device 400 may be provided in the body and the switching device 400 is able to grow the dust compression part 100 by a pressure difference of air generated via selective communication of the inlet of the vacuum motor 10, the outlet of the vacuum motor 10 with the dust compression part 100 of the dust collection device 30.

Figure 2:
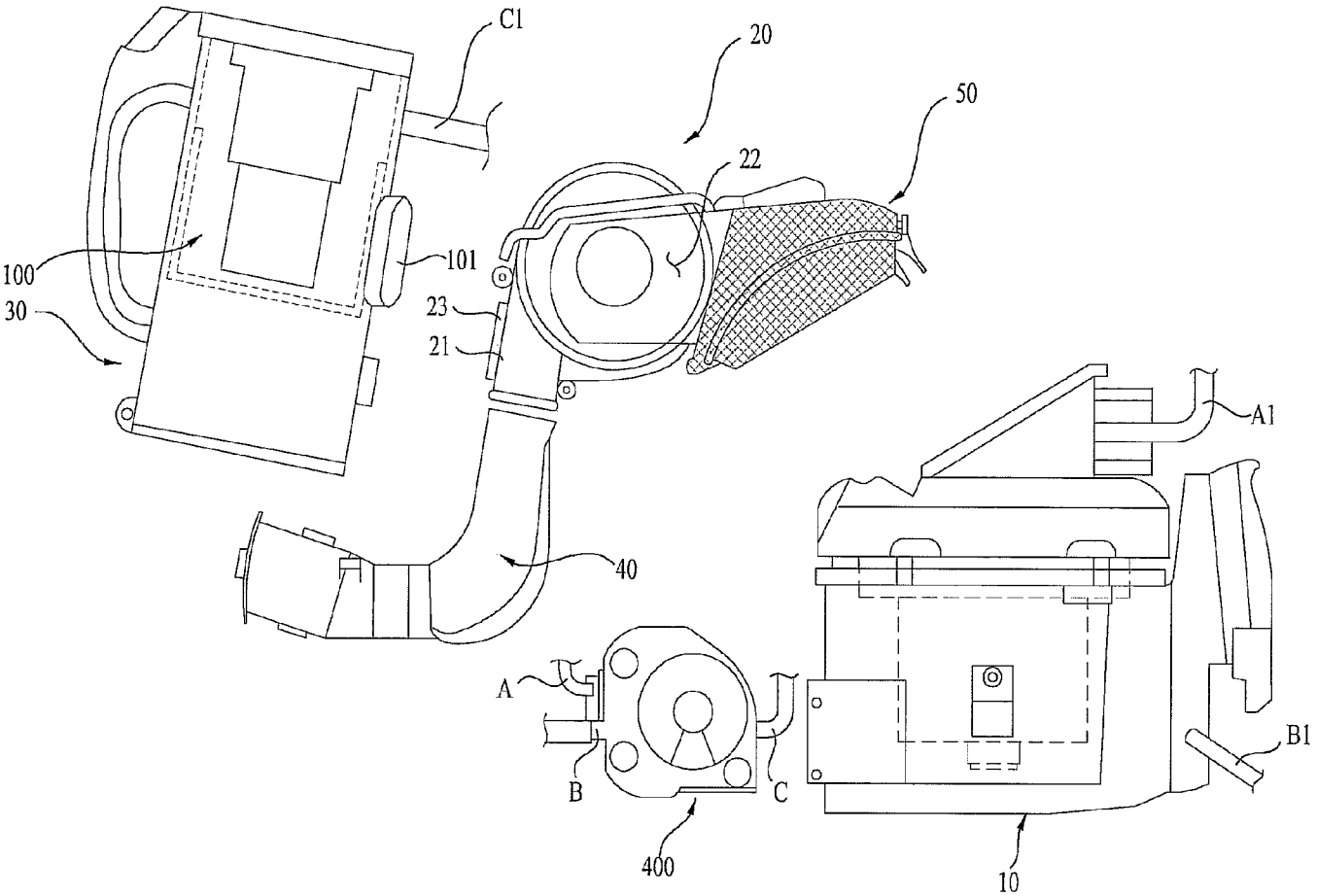
FIG. 2 is a side view illustrating a dust collection device, a filter device and a vacuum motor which are separated from each other.

As shown in FIG. 2, there may be three communication holes provided in the switching device 400. One of the communication holes referenced to as "A" may be connected with the inlet of the vacuum motor (A1) (a low pressure part) and another one referenced to as "B" may be connected with the outlet of the vacuum motor (B1) (a high pressure part).

The other one referenced to as "C" may be in communication with an internal space of the dust compression part 100 provided in the dust collection device 30.

"A" may be in communication with "C" based on the operation of the switching device 400 or "B" may be in communication with C.

When the inlet of the vacuum motor 10 (the low pressure part) is in communication with the dust compression part 100, a pressure possessed by the internal space of the dust collection device 30, namely, an external space of the dust compression part 100 may be higher than a pressure possessed by the inlet of the vacuum motor 10 (the low pressure part). Because of that, flow of air may be toward the inlet of the vacuum motor 10 (the low pressure part) from the internal space of the dust collection device 30 and the size of the dust compression part 100 may be decreased.

However, when the outlet of the vacuum motor 10 (the high pressure part) is in communication with the dust compression part 100, the pressure possessed by the internal space of the dust collection device 30, namely, an external space of the dust compression part 100 may be lower than the outlet of the vacuum motor 10 (the high pressure part).

Because of that, the air flow may be toward the dust collection device 30 from the outlet of the vacuum motor 10 (the high pressure part).

As a result, the size of the dust compression part 100 may be expanded and a lower end of the dust compression part 100 may be moved toward a lower area of the dust collection device 30, to press the collected dust.

It is mentioned that the outlet of the vacuum motor 10 is the high pressure part and the inlet of the vacuum motor 10 is the low pressure part.

However, the low pressure part may be set to be one of the internal space or the external space of the body 1 of which the pressure can be maintained lower than the pressure of the internal space of the dust collection device 30 and the high press part may be set to be the other one of which the pressure can be maintained higher than the pressure inside the dust collection device 30.

In the meanwhile, a suction pipe 21 may be provided underneath the dust separation device 20 to suck air together with dust and an air outlet 22 may be provided in a side surface of the dust separation device 20 to exhaust the air separated from the dust. In addition, a dust outlet 23 may be provided in a front surface of the dust separation device 20 to exhaust the dust.

The suction pipe 21 may be connected with the guide passage 40 and it may receive the dust and air drawn into the suction nozzle (not shown).

The air outlet 22 may be connected with the filter device 50 and the dust outlet 23 may be connected with an inlet part 101 of the dust collection device 30.

Figure 3:
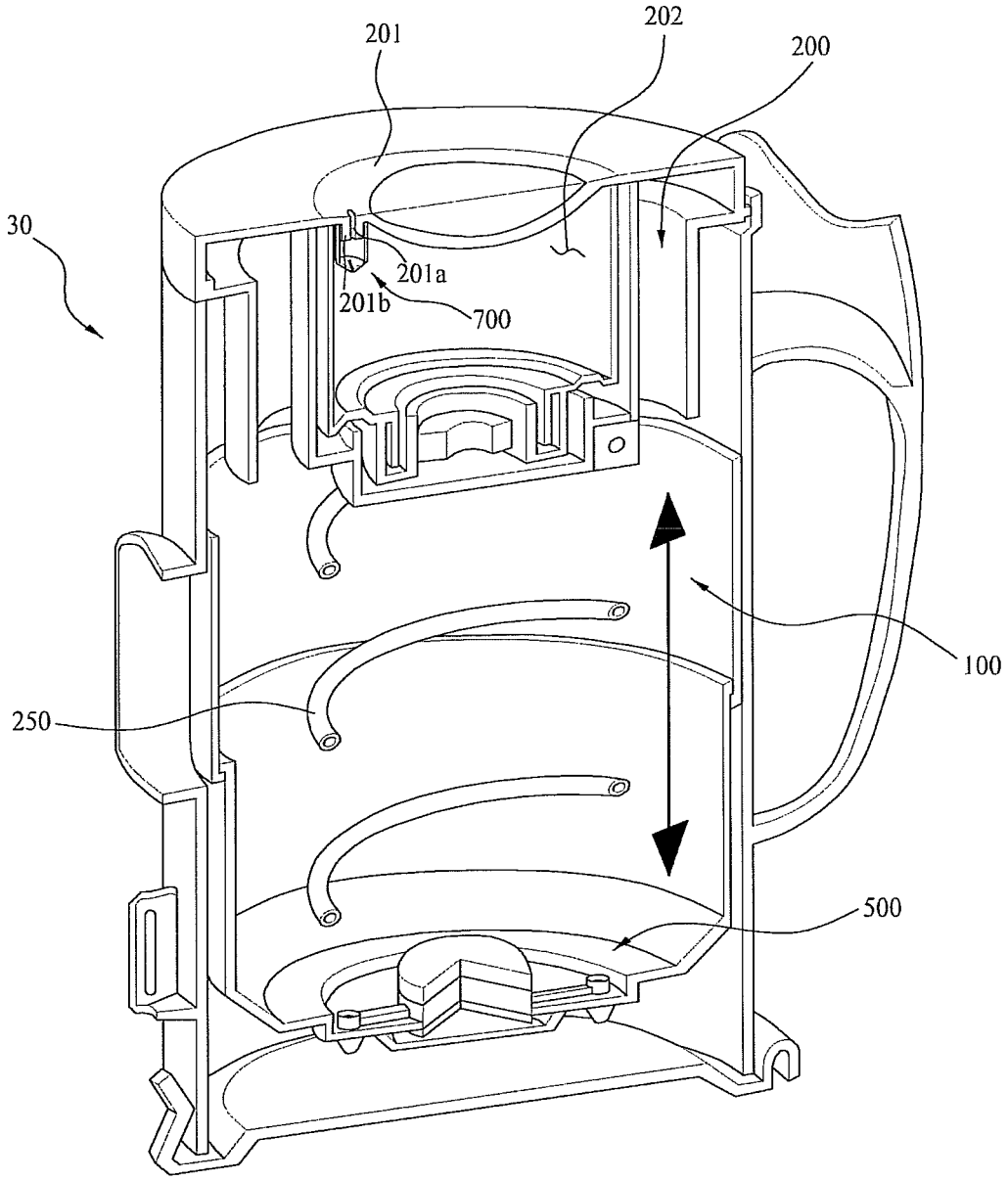
FIG. 3 is a perspective view illustrating an internal structure of the dust collection device provided in the vacuum cleaner according to the embodiment.

As shown in FIG. 3, the dust compression part 100 that is extendible may be provided in the dust collection device 30.

The dust compression part 100 may be a multi-stepped pipe with an extendible length (a telescopic pipe) or an element with an expandable or contractible volume such as a balloon The liquid accommodation part 200 configured to accommodate a liquid used for dust solidification may be installed in the dust compression part 100 and a cap 201 of the liquid accommodation part 200 may be provided in a top of the dust compression part 100 such that the user may refill the liquid the accommodation part 200 with the liquid smoothly and easily.

A liquid exhaustion part 500 may be installed in a bottom of the dust compression part 100 to exhaust the liquid to the dust collection device 30 when the dust compression part 100 is performing dust compression.

The liquid exhaustion part 500 and the liquid accommodation part 200 may be connected via the guide pipe 250. The guide pipe 250 may be a coil type of which arrangement can be flexibly changed according to the extended length of the dust compression part 100.

In other words, the height of the arrangement may be increased or decreased.

The liquid accommodation part 200 and the guide pipe 250 and an upper part of the liquid exhaustion part 500 may be arranged in the dust compression part 100. A lower part of the liquid exhaustion part 500 may be exposed to the bottom of the dust compression part 100.

As a result, the liquid used for dust solidification may be sprayed or exhausted from the lower part of the liquid exhaustion part 500 exposed to the bottom of the dust compression part 100 selectively.

Figure 4:
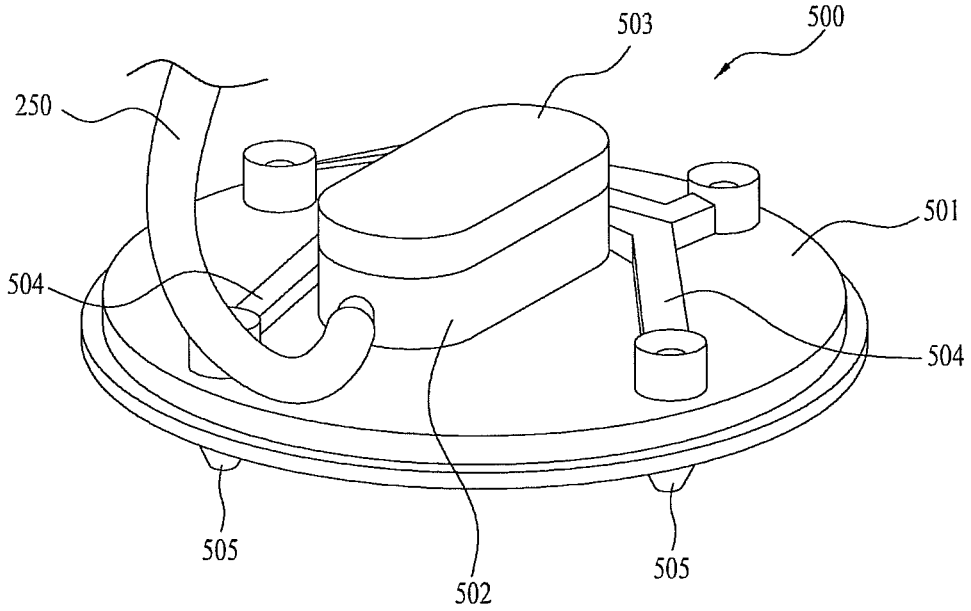
FIG. 4 is a perspective view illustrating an exterior appearance of a liquid exhaustion part according to a first embodiment that is provided in the vacuum cleaner.

As shown in FIG. 4, the liquid exhaustion part 500 may include a mounting plate 501 mounted to the bottom of the dust compression part (100, see FIG. 3), a receiving part 502 configured to receive an opening/closing member which will be described later and configured to be connected with the guide pipe 250, and a receiving part cover 503 to cover the receiving part 502.

The mounting plate 501 may include an outlet passage 504 extended from the receiving part 502 along a radial direction to guide the liquid and an outlet nozzle 505 provided at an end of the outlet passage 504 to spray the liquid having passed the outlet passage 504 outside.

Here, the guide pipe 250 may be connected with a side of the receiving part 502 and the outlet passages 504 may be connected with an opposite side of the receiving part 502.

After the liquid moving along the guide of the guide pipe 250 is drawn into one side of the receiving part 502, the liquid may be exhausted via the opposite side of the receiving part 502 and it may move toward the outlet passage 504.

Figure 5:
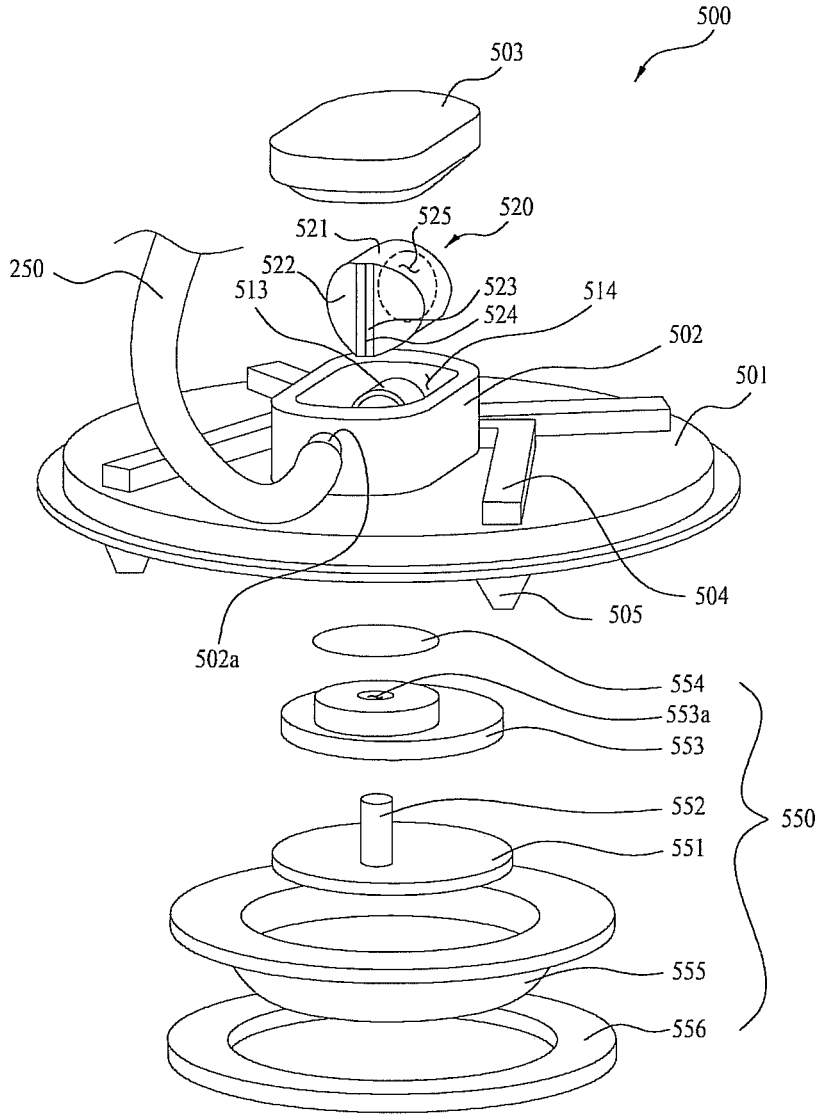
FIG. 5 is an exploded perspective view illustrating the liquid exhaustion part according to the first embodiment.

As shown in FIG. 5, the receiving part 502 may be provided in a center of the mounting plate 501 to receive the opening/closing member 520.

The guide pipe 250 may be connected with a pipe-shaped connection part **502*a* provided in the side of the receiving part 502. The outlet passage 504 may be connected with the opposite side of the receiving part 502** and it may be branched in several directions.

The receiving part cover 503 may be provided in the top of the receiving part 502 to cover an internal space of the receiving part 502. The internal space of the receiving part 502 and the receiving part cover 503 may define a proper space to mount the opening/closing member 520 therein.

Here, an inlet passage 514 to draw the liquid there through may be formed in the flow space formed by the receiving part 502 and the receiving part cover 503.

A coupling pipe 513 may be provided in the inlet passage 514 to couple the opening/closing member 520 thereto.

The coupling pipe 513 may fix the position of the opening/closing member 520 and it may guide the liquid that passes the opening/closing member 520 toward the outlet passage 504.

The opening/closing member 520 may include a cylindrical body portion 521 with an empty inside, a slope portion 522 provided in a side of the body portion 521, a plane portion 523 formed in an end of the slope portion 522 and a slit portion 524 formed in the plane portion 523.

An outlet 525 may be provided in the other opposite side of the opening/closing member 520, and the liquid passing the slit 524 may be exhausted via the outlet 525. Here, the outlet 525 may be inserted in the coupling pipe 513.

The opening/closing member 520 may be mounted in the inlet passage 514, with a predetermined length. Because of that, a cross-sectional shape of the inlet passage 514 may be a hole shape.

Here, the opening/closing member 520 may be formed of silicon or rubber. When an external shock is applied, the opening/closing member 520 may be transformed.

As a result, unless the external shock is applied, the slit portion 524 may be closed and the liquid may not pass the slit portion 524. If the external shock is applied to transform the opening/closing member 520, the slit portion 524 may be open to allow the liquid to pass there through.

A force transmitting device 550 may be provided under the opening/closing member 520 and the force transmitting device 550 may transmit a force to the opening/closing member 520 to move it upward.

The force transmitting device 550 may include a movable plate 551 that is movable upward and downward, that is, vertically, a force transmitting member 552 upwardly extended from a center of the movable plate 551 to be arranged toward the opening/closing member 520, and a guide member 553 having the force transmitting member therein to guide the movement of the force transmitting member 552.

Here, the force transmitting member 552 may be a pin or bar type. The guide member 553 may be a plate type where an insertion hole 553*a* is formed to insert the force transmitting member 552 therein and the guide member 553 may be arranged on the movable plate 551.

A sealing member 554 formed of a flexible material may be provided on a top of the guide member 553 and the sealing member 554 may be provided between an upper end of the force transmitting member 552 and a lower end of the opening/closing member 520.

The sealing member 554 may be used for sealing to prevent the liquid from penetrating toward the force transmitting device 550.

In the meanwhile, the force transmitting device 550 may further include a cover member 555 configured to receive the movable plate 551, the force transmitting member 552 and the guide member 553 to prevent them from exposed outside.

A rim of the cover member 555 may be fixed to a lower surface of the mounting plate 501 and a fixing member 556 formed in a circular shape may be provided in the rim of the cover member 555 to fix the cover member 555.

The cover member 555 may be formed of a flexible material.

As a result, when a lower end of the dust compression part 100 contacts with the dust to compress because of the downward movement of the dust compression part 100, a dust mass may be compressed to contact with lower and side surfaces of the cover member 555.

The compressed dust mass may have a predetermined strength and rigidity. When the compressed dust mass is moved downwardly by the dust compression part 100 in a state of contact with the cover member 555, the force may be transmitted toward the cover member 555 from the dust mass by a reaction of the dust compression.

The cover member 555 may be transformed by a repulsive power and the movable plate 551 and the force transmitting member 552 may be moved upwardly.

The upward movement of the force transmitting member 552 may transform the opening/closing member 520 and the slit portion 524 may be open accordingly.

After that, the inlet passage 514 may be in communication with the outlet passage 504 and the liquid may be exhausted along the outlet passage 504.

In the meanwhile, the outlet nozzle 505 may be provided at an end of the outlet passage 504 to exhaust the liquid.

The outlet nozzle 505 may be extended from the lower surface of the mounting plate 501 downwardly, to guide the downward exhaustion of the liquid.

Figure 6:
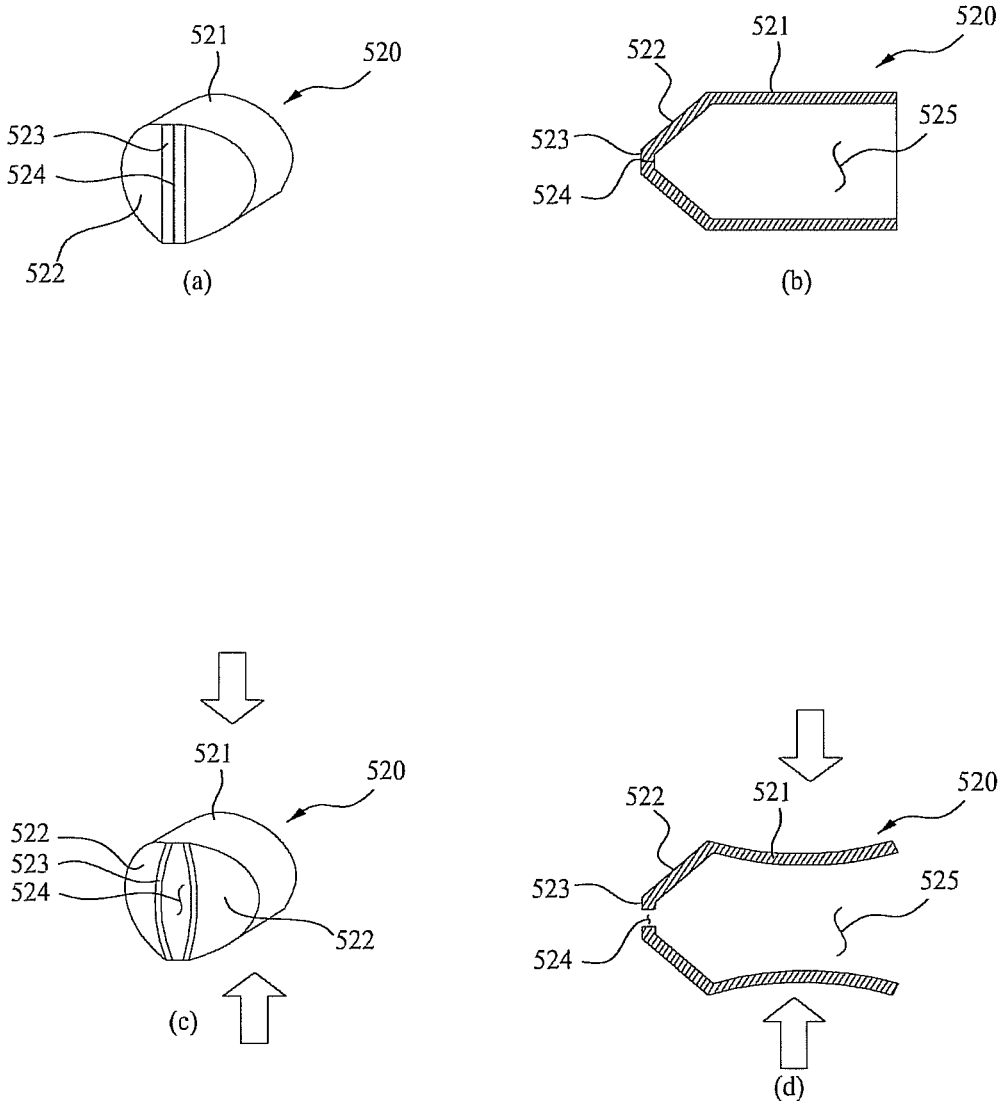
FIGS. 6(*a*) and 6(*b*) are a perspective view and a side sectional view illustrating an opening/closing member of the liquid exhaustion part according to the first embodiment, before transformed.

FIG. 6 illustrates a detailed structure of the opening/closing member 520.

As shown in FIGS. 6(*a*) and 6(*b*), the opening/closing member 520 may include the body portion 521 formed in a bullet shape, with a predetermined hollow portion, the slope portion 522 formed at the end of the body portion 521, the plane portion 523 formed at the end of the slope portion 522 and the slit portion 524 provided in the plane portion 523 linearly.

The opening/closing member 520 may be a check valve that is transformed by a pressing force of the dust compressed by the dust compression part 100, to pass the liquid there through, and that is restituted when the pressing force is removed, to shut off the flow of the liquid.

As mentioned above, the coupling pipe (513, see FIG. 5) may be inserted in the other opposite side of the opening/closing member 520. When the slit portion 524 is open, the liquid may be exhausted via the outlet 525 after passing the slit 524.

The reason why the opening/closing member 520 is not formed in a simple cylindrical shape but formed with the slope portion 522 formed in the end thereof is that the slit portion 524 is open smoothly by the transformation.

If the external shock generating the profile transformation is removed, the slit portion 524 may be closed quickly.

FIGS. 6(*c*) and 6(*d*) illustrate that an external shock is applied to the top or bottom of the opening/closing member, in a state of the opening/closing member 520 being arranged horizontally.

When the external shock is applied to the top or bottom of the opening/closing member 520, the body portion 521 of the opening/closing member 520 may become flat and a horizontal width may be increased.

As the horizontal width is getting increased, the slit portion 524 may be opened.

To open the slit portion 524 smoothly, the external shock has to be applied upward or downward if the slit portion 524 is arranged vertically.

If the slit portion 524 is arranged horizontally, the external shock has to be applied leftward or rightward.

Since it is formed of rubber or silicon as mentioned above, the opening/closing member 520 may be transformed flexibly based on applying or removing of the external shock.

Figure 7:
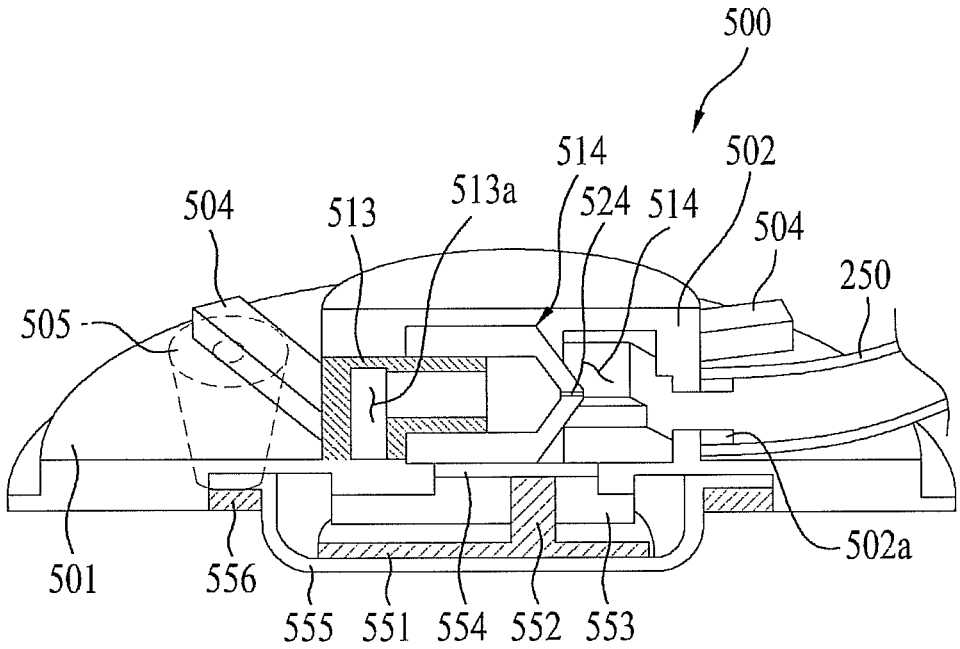
FIG. 7 is a side sectional view illustrating the liquid exhaustion part according to the first embodiment that is provided in the vacuum cleaner.

As shown in FIG. 7, the opening/closing member 520 may be provided in the inlet passage 514 and the coupling pipe 513 may be inserted in the opening/closing member 520 to fix the opening/closing member 520.

The coupling pipe 513 may be bent in a "¬".

The connection part 502*a* having a pipe shape provided in the side of the accommodation part 502 may be connected with the guide pipe 250. The liquid may be drawn into the inlet passage 514 along the guide of the guide pipe 250.

The sealing member 554 may be provided underneath the opening/closing member 520. The force transmitting member 552 and the guide member 553 and the movable plate 551 connected with the force transmitting member 552 may be provided under the sealing member 554.

The sealing member 554 may be provided between the inlet passage 514 and the guide member 553, to prevent the liquid moving in the inlet passage 514 from penetrating toward the force transmitting member 552.

The cover member 555 may cover the force transmitting member 552, the movable member 551 and the guide member 553, to prevent the dust and foreign matters to coming into the cover member 555.

As a result, when the pressure is applied to the bottom of the cover member 555, the movable plate 551 and the force transmitting member 552 may be moved upward and the shock may be applied to the opening/closing member 520. Because of that, the profile of the opening/closing member 520 may be transformed.

After that, the slit portion (524, see FIG. 6) may be open and the inlet passage 514, a passage part 513*a* and the outlet passage 504 may be in communication with each other such that the liquid may flow.

A numeral reference of "505" is the outlet nozzle to exhaust the liquid moved from the outlet passage 504.

A numeral reference referring to the liquid exhaustion part according to a second embodiment may be "600".

The liquid exhaustion part 600 may include a mounting plate 601 mounted to a bottom of the dust compression part (100, see FIG. 2).

A receiving part 602 configured to receive an opening/closing member 620 may be provided in a center of the mounting plate 601.

The opening/closing member 620 may control flow of liquid according to the profile transformation generated by an external shock, like the opening/closing member (520, see FIG. 6) according to the first embodiment.

A receiving part cover 603 may be provided on the receiving part 602 to cover an internal space of the receiving part 602. A space where the opening/closing member 620 will be mounted may be defined by the internal space of the receiving part 602 and the receiving part cover 603.

The guide pipe 250 may be connected with a pipe type connection part 603*a* provided in a side of the receiving part cover 603.

The outlet passage 604 may be connected with the receiving part 602, with being branched in several directions.

An inlet passage 614 may be formed in the flow space defined by the receiving part 602 and the receiving part cover 603.

The opening/closing member 620 may include a body portion 621 with an empty inside, a slope portion 622 provided in a side of the body portion 621, a plane portion 623 formed in an end of the slope portion 622 and a slit portion 624 formed in the plane portion 623.

An outlet 625 may be provided in the other opposite side of the opening/closing member 620 and the liquid passing the slit portion 624 may be exhausted via the outlet 625. A projection 626 may be projected from a lower rim of the opening/closing member 620 outward.

The projection 626 may be in contact with an inner wall of the inlet passage 614, to fix the opening/closing member 620 without moving inside the inlet passage 614.

An appearance formed by the body portion 621 and the slope portion 622 may be similar to a bullet. This is because the slit portion 624 has to be opened smoothly, if a predetermined pressure is applied upward by a predetermined element in contact with the lower inner surface of the slope portion 622.

Here, the opening/closing member 620 may be mounted in the inlet passage 614 vertically, with a predetermined length.

In the meanwhile, a movable member 630 may be provided under the opening/closing member 620 to be inserted in the opening/closing member 620 and the movable member 630 may move vertically.

The movable member 630 may be configured of a lower body portion 631 and an upper body portion 632. The lower body portion 631 may be cylindrical and the upper body portion 632 may be provided on the lower body portion 632, with a tapered cross section having a getting smaller width upwardly.

When the movable member 630 is inserted in the opening/closing member 620, a rim of an upper end possessed by the upper body portion 632 may be in contact with an inner surface of the slope portion 622.

Here, the opening/closing member 620 may be formed of silicon or rubber and it may be transformable when an external shock is applied thereto.

As a result, when a direct shock is not applied to the opening/closing member 620 without the upward movement of the movable member 630, the slit portion 624 may be closed and the liquid cannot pass the slit portion 624.

Here, when the opening/closing member 620 is transformed by an external shock applied to the slope portion 622 with the upward movement of the movable member 630, the slit portion 624 may be opened and the liquid may pass the slit portion 624.

A force transmitting device 550 may be provided under the movable member 630 and the force transmitting device 550 may open the slit portion 624 of the opening/closing member by generating the upward movement of the movable member 630.

The force transmitting device 550 may include a movable plate 551 that is movable vertically, a force transmitting member 552 extended from a center of the movable plate 551 upward to the opening/closing member 520, and a guide member 553 inserted in the force transmitting member 552 to guide the movement of the force transmitting member 552.

Here, the force transmitting member 552 may be a pin or bar type. The guide member 553 may be a plate type, with an insertion hole 553*a* having the force transmitting member 552 inserted therein, and it may be arranged on the movable plate 551.

A sealing member 550 formed of a flexible material may be provided on the guide member 553 and the sealing member 550 may be provided between an upper end of the force transmitting member 552 and a lower end of the movable member 630.

The sealing member 550 may be employed for sealing to prevent the liquid from penetrating into toward the force transmitting device 550, In the meanwhile, the force transmitting device 550 may further include a cover member 555 to cover the movable plate 551, the force transmitting member 552 and the guide member 553 and to prevent them from exposed outside.

A rim of the cover member 555 may be fixed to a lower surface of the mounting plate 501 and a circular fixing member 556 may be arranged in the rim of the cover member 555 to fix the cover member 555.

The cover member 555 may be formed of a flexible material.

As a result, when a lower end of the dust compression part 100 contacts with the dust to compress because of the downward movement of the dust compression part 100, a dust mass may be compressed to contact with lower and side surfaces of the cover member 555.

The compressed dust mass may have a predetermined strength and rigidity. When the compressed dust mass is moved downwardly by the dust compression part 100 in a state of contact with the cover member 555, the force may be transmitted toward the cover member 555 from the dust mass by a reaction of the dust compression.

In other words, the dust mass may press the cover member 555.

The cover member 555 may be transformed by the press and the movable plate 551 and the force transmitting member 552 may be moved upwardly.

The upward movement of the force transmitting member 552 may move the movable member 630 and the movable member 630 may apply an external shock to the opening/closing member 620. Because of that, the opening/closing member 620 may be transformed by the external shock and the slit portion 624 may be open accordingly.

After that, the inlet passage 614 may be in communication with the outlet passage 604 and the liquid may be exhausted along the outlet passage 604.

In the meanwhile, an outlet nozzle 605 may be provided at an end of the outlet passage 604 to exhaust the liquid.

The outlet nozzle 605 may be extended from the lower surface of the mounting plate 601 downwardly, to guide the downward exhaustion of the liquid.

As mentioned above, the dust compression is generated by the dust compression part 100 and the external shock is transmitted to the liquid exhaustion part 600 from the compressed dust. This means that the liquid may be exhausted by the liquid exhaustion part 600 enough for the dust to provide a predetermined pressure.

In other words, dust may be mechanically detected by the liquid exhaustion part 600 to exhaust the liquid.

If the dust has a small amount enough not to contact with the liquid exhaustion part 600, the liquid may not be exhausted from the liquid exhaustion part 600 even with the compression performed by the dust compression part 100.

As a result, the liquid exhaustion part 600 may be opened selectively based on whether it is pressed by the dust collected in the dust collection device 30 or not, to exhaust the liquid toward the dust.

Such a principle of liquid exhaustion based on dust detection may be applicable to the second embodiment.

Figure 9:
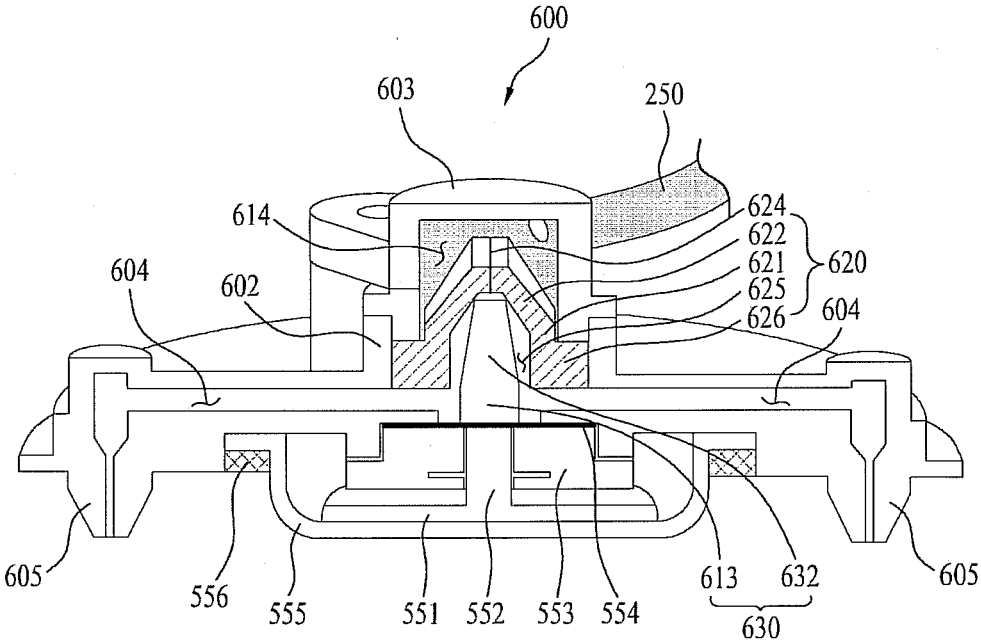
FIG. 9 is a side section view illustrating the liquid exhaustion part according to the second embodiment that is provided in the vacuum cleaner.

As shown in FIG. 9, the opening/closing member 620 may be provided in the inlet passage 614.

A projection 626 may be in contact with an inner wall of the receiving part 602 to fix the opening/closing member 620 without moving in the inlet passage 614. Then, the projection 626 may be pressed by the receiving part cover 603.

When the receiving part 602 and the receiving part cover 603 are coupled to each other by a proper coupling member, for example, a bolt, a rivet or a hook, the movement of the opening/closing member 620 may be prevented.

The movable member 630 may be arranged in the opening/closing member 620 that is in a status of being fixed. As mentioned above, the movable member 630 may be configured of the lower body portion 631 and the upper body portion 632.

A lower end of the lower body portion 631 may be arranged on the sealing member and a rim of an upper end of the upper body portion 632 may be in contact with an inner surface of the slope portion 622.

The width of the internal space formed in the opening/closing member 620 may be larger than the width of the movable member 630. Because of that, a predetermined space may be formed near the movable member 630.

Such a space may be in communication with the outlet passage 604.

As a result, when the slit portion 624 is opened by the upward movement of the movable member 630, the liquid located in the inlet passage 614 may be exhausted outside the liquid exhaustion part 600 after passing the slit portion 624, the space near the movable member 630, the outlet passage 604 and the outlet nozzle 605 sequentially.

After that, dust may be compressed by the dust compression part 100 and an external force may be transmitted to the liquid exhaustion part 600 from the compressed dust. This means that the liquid exhaustion part 600 may detect the compressed dust mass mechanically.

In other words, it is detected that the compressed dust mass is enlarged enough to provide a repulsive power or a pressure toward the liquid exhaustion part 600 and the necessity may be satisfied that the liquid may be exhausted toward the compressed dust mass to solidify the dust mass.

If the dust has a small amount not enough to contact with the liquid exhaustion part 600, the liquid cannot be exhausted from the liquid exhaustion part 600 even with the compression performed by the dust compression part 100.

Figure 10:
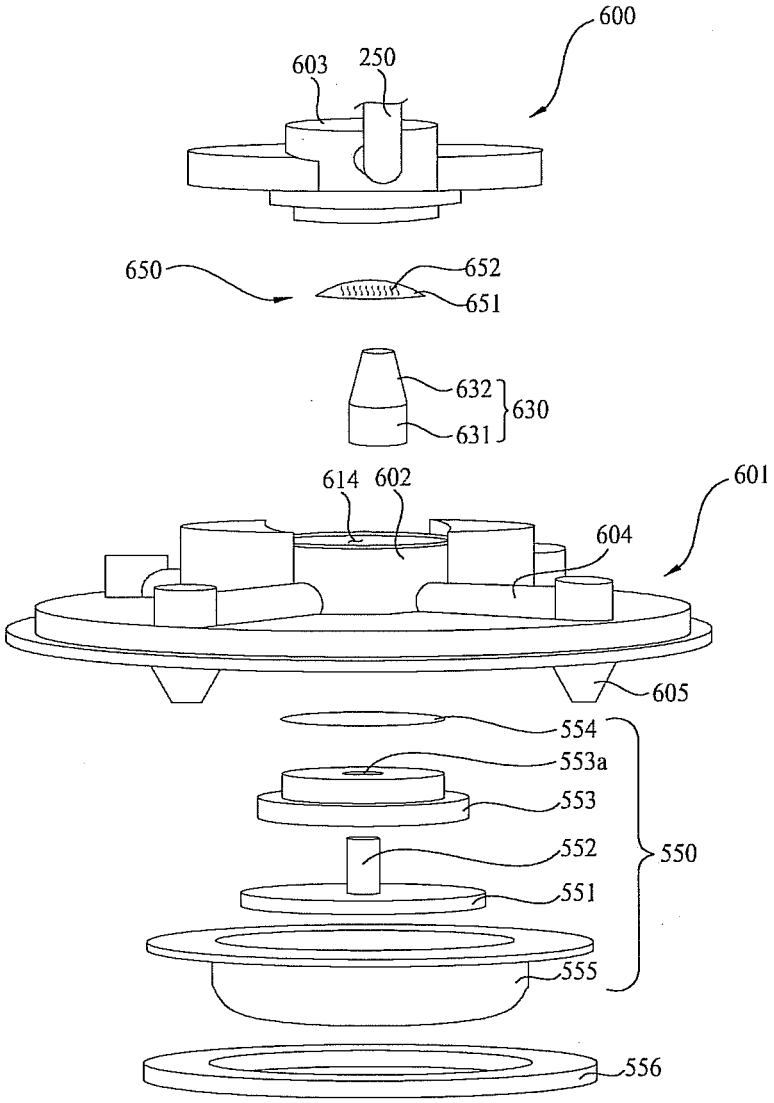
FIG. 10 is an exploded perspective view illustrating a liquid exhaustion part according to a third embodiment that is provided in the vacuum cleaner.

FIG. 10 is an exploded perspective view illustrating a liquid exhaustion part according to a third embodiment.

In the second embodiment, the opening/closing member (620, see FIG. 8) may have the hollow cylinder shape. In the third embodiment, an opening/closing member 650 according to the third embodiment provided in the liquid exhaustion part 600 may include a body portion 651 formed in a sheet or plate shape and at least one slit portion 652 formed in a surface of the body portion 651.

The body portion 651 may be curved with a predetermined curvature or it may be plane.

The opening/closing member 650 may be formed of a flexible material such as rubber or silicon, to be transformed smoothly when an external shock is applied thereto and to be restituted when the external shock is removed.

When the opening/closing member 650 is transformed, the slit may be widened and the slit portion 652 may be opened. When the opening/closing member 650 is restituted, the slit of the slit portion 652 may be getting narrowed to close the slit portion 652.

A movable member 630 may be provided under the opening/closing member 650. When the force is applied to the opening/closing member 650 upwardly from the bottom, the movable member 630 may maintain a state of being able to apply the force to the opening/closing member 650.

Figure 8:
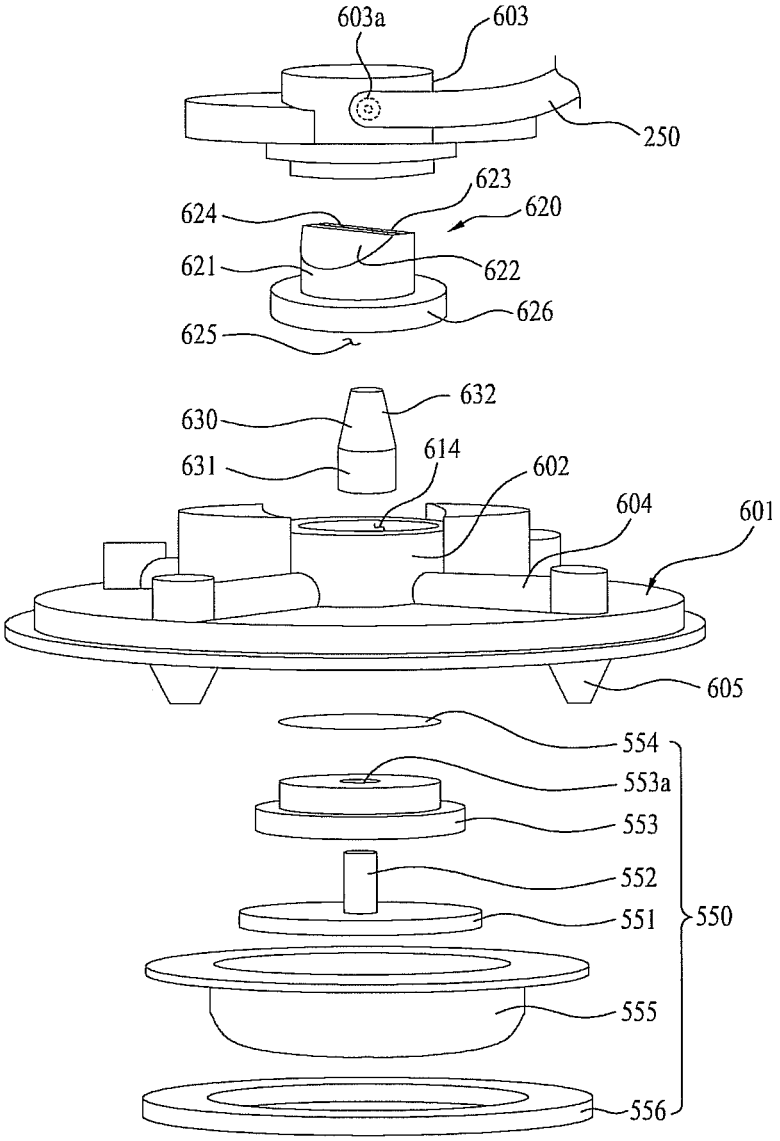
FIG. 8 is an exploded perspective view illustrating a liquid exhaustion part according to a second embodiment that is provided in the vacuum cleaner.

The other ones except the structural components mentioned above are identical to the corresponding ones represented in the second embodiment shown in FIG. 8 and detailed description thereof will be omitted accordingly.

Figure 11:
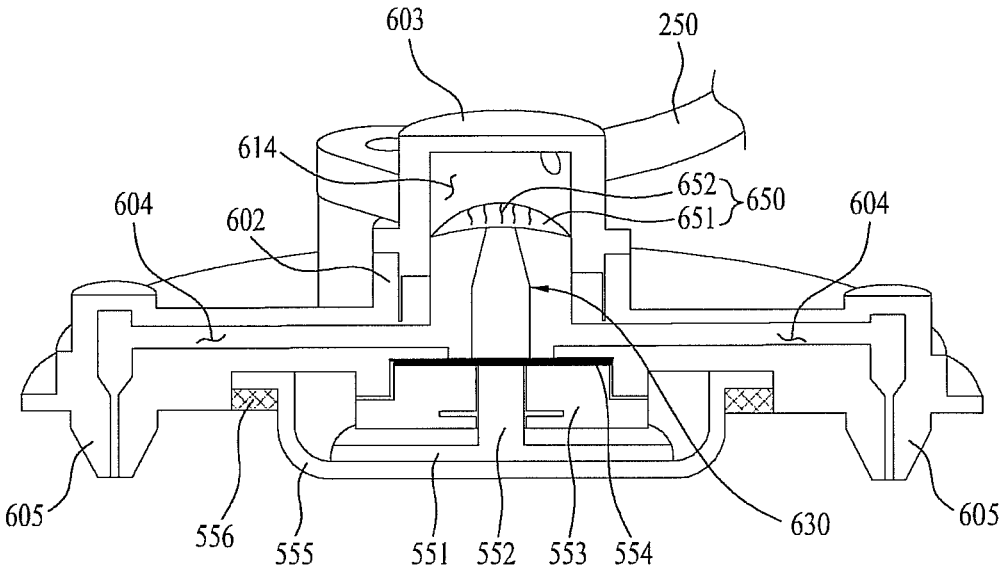
FIG. 11 is a side sectional view illustrating the liquid exhaustion part according to the third embodiment that is provided in the vacuum cleaner.

As shown in FIG. 11, the opening/closing member 650 may be arranged in the inlet passage 614 and a rime of the opening/closing member 650 may be fixed to an inner wall of the inlet passage 614.

The movable member 630 may be configured of a lower body portion (631, see FIG. 10) and an upper body portion (632, see FIG. 10).

The lower portion part 631 may be in contact with the sealing member 554 arranged there under and an upper rim of the upper body portion 632 may be in contact with a lower surface of the opening/closing member 650.

As a result, when the force is transmitted to the movable member 630 by the force transmitting device 550, the movable member 630 may be moved upward and the opening/closing member 650 may be lifted upward.

At this time, the rim of the opening/closing member 650 may be fixed and a surface area may be increasing as a center soars upward. Because of that, the slit portion 652 may be opened.

In the meanwhile, a lower space of the opening/closing member 650 may be in communication with the outlet passage 604 and the width of the lower space may be larger than the width of the movable member 630, such that a predetermined space may be formed near the movable member 630.

When the slit portion 652 is opened, the liquid located in the inlet passage 614 may be exhausted outside after passing the outlet passage 604 and the outlet nozzle 605 sequentially.

The other ones except the components described above are identical to the corresponding ones represented in the second embodiment shown in FIG. 9 and detailed description thereof will be omitted accordingly.

As follows, an operation of the vacuum cleaner according to the embodiment will be described in reference to the accompanying drawings.

Figure 12:
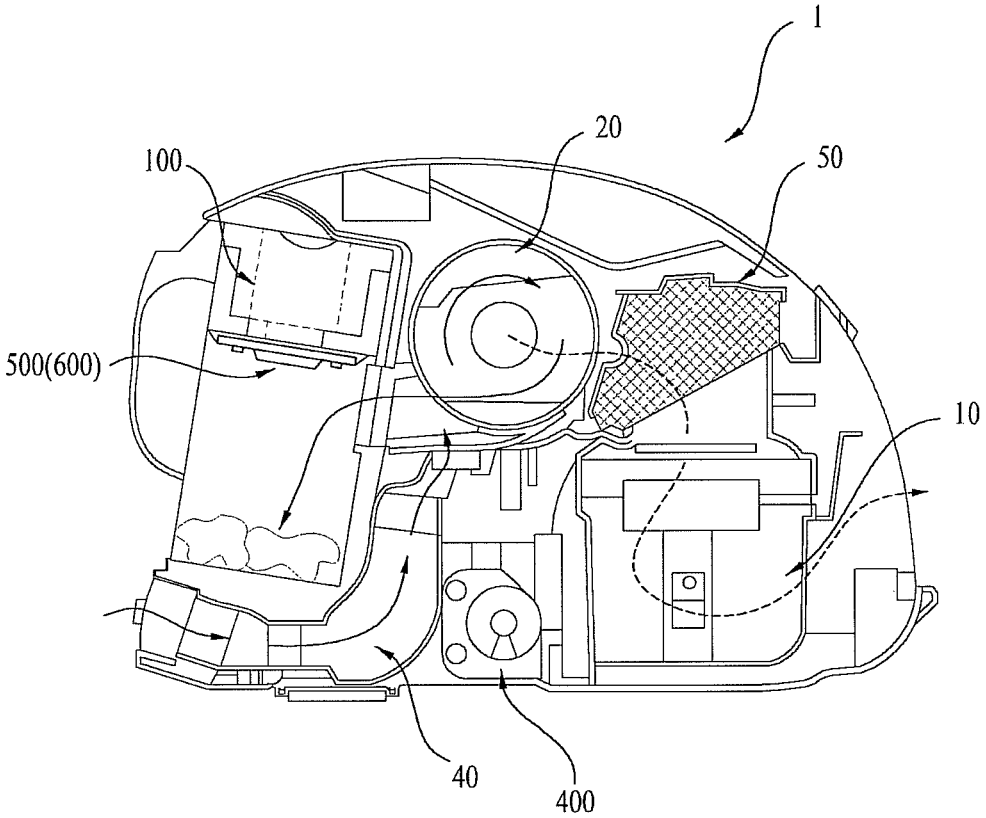
FIG. 12 is a diagram illustrating a status dust before compressed while collected in the body.

As shown in FIG. 12, the vacuum motor 10 is driven and the dust and air sucked via the suction nozzle (not shown) may be drawn into the dust separation device 20.

The dust may be separated from the air based on the cyclone theory within the dust separation device 20 and the separated dust may be drawn into the dust collection device 30.

The air separated from the dust may be sucked to the vacuum motor 10 via the filter device 50 and it may be exhausted outside the body after that.

The dust drawn into the dust collection device 30 may be collected in the lower area of the dust collection device 30. At this time, the inlet of the vacuum motor (the low press part) may be in communication with the internal space of the dust compression part 100 by the switching device 400.

Figure 13:
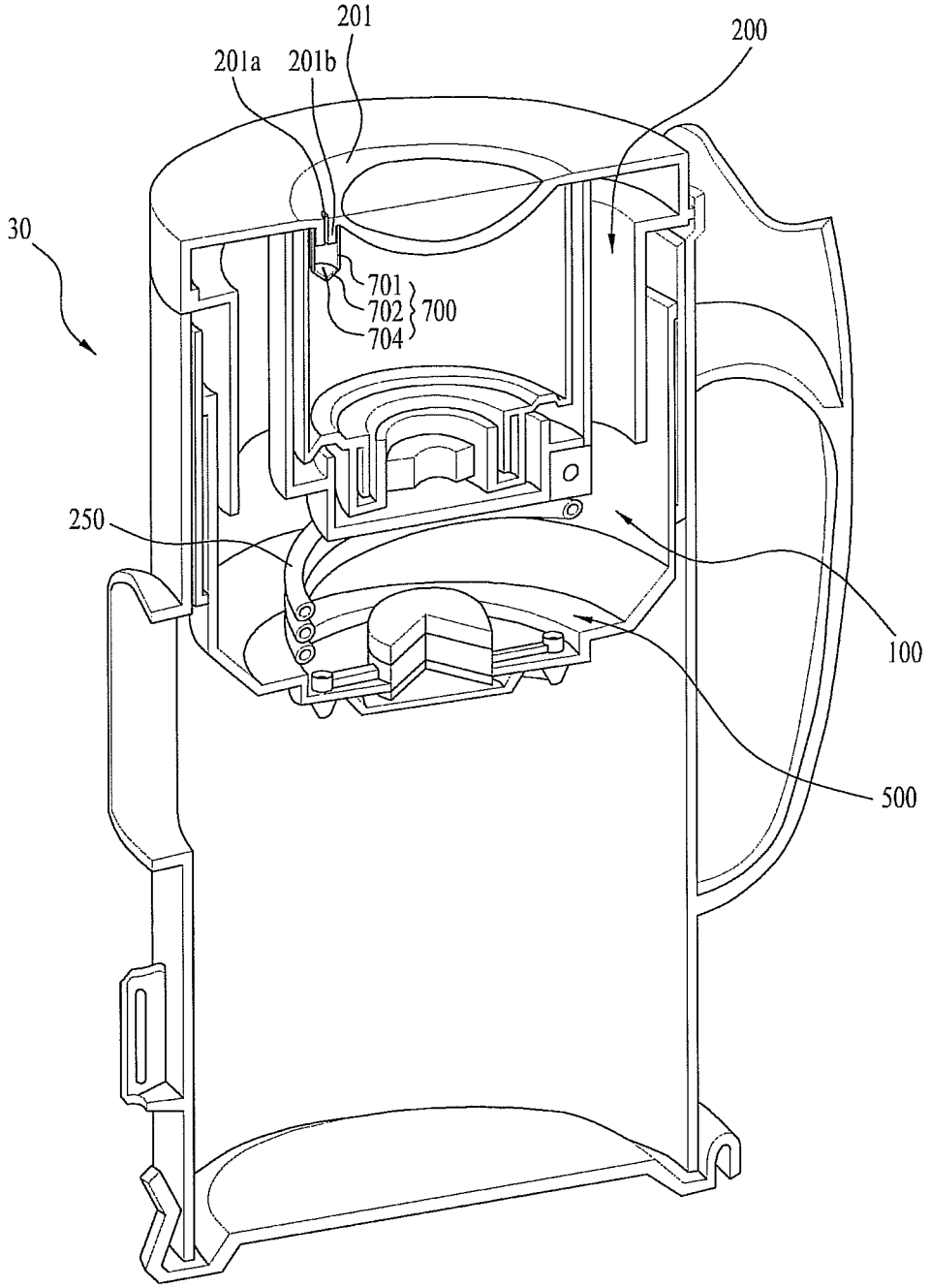
FIG. 13 is a perspective view illustrating a status of the dust before compressed in the dust collection device.

In this case as shown in FIG. 13, the length of the dust compression part 100 may be decreased and the lower area of the dust compression part 100 may be spaced apart a predetermined distance from a bottom surface of the dust collection device 30.

As a result, the liquid exhaustion part 500 and 600 may be spaced apart a predetermined distance from the bottom surface of the dust collection device 30.

In the status of the length of the dust compression part 100 being decreased, the dust compression part 100 may not perform the dust compression function and the dust or the dust mass may not press the liquid exhaustion part 500 and 600.

Figure 14:
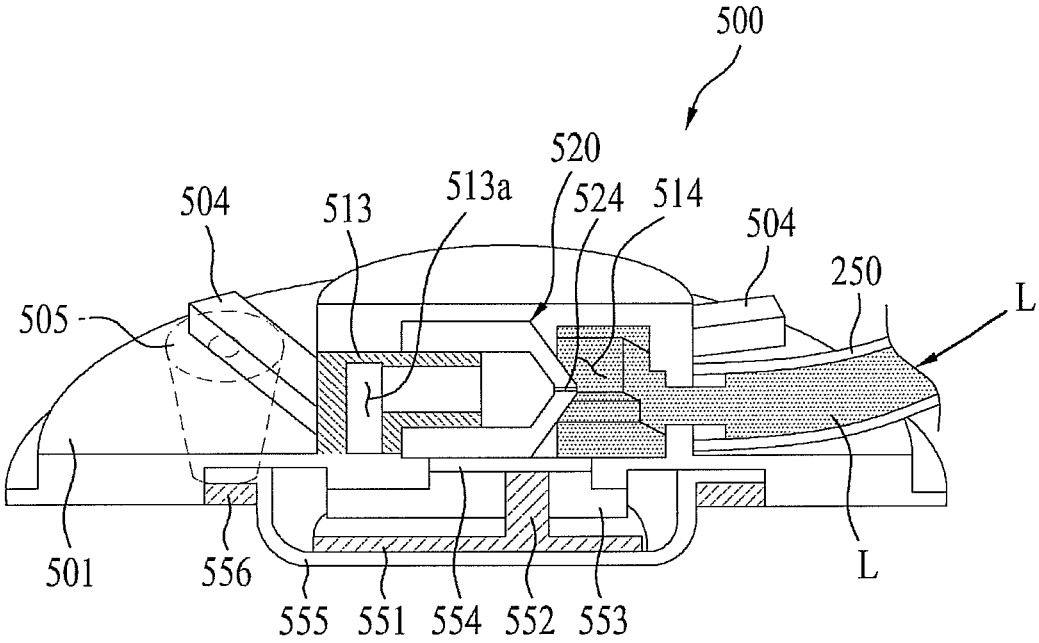
FIG. 14 is a side sectional view illustrating a status of a liquid before exhausted from the liquid exhaustion part according to the first embodiment.

As shown in FIG. 14 in the first embodiment, when the force transmitting device 550 is not pressing the opening/closing member 520, the opening/closing member 520 may maintain its initial status.

As a result, the slit portion 524 may be maintained the closed status.

When the slit portion 524 maintains the closed status, the liquid (L) drawn into the inlet passage 514 along the guide of the guide pipe 250 may not move toward the passage part 513*a* and the outlet passage 504, with being located in the inlet passage 514.

Figure 15:
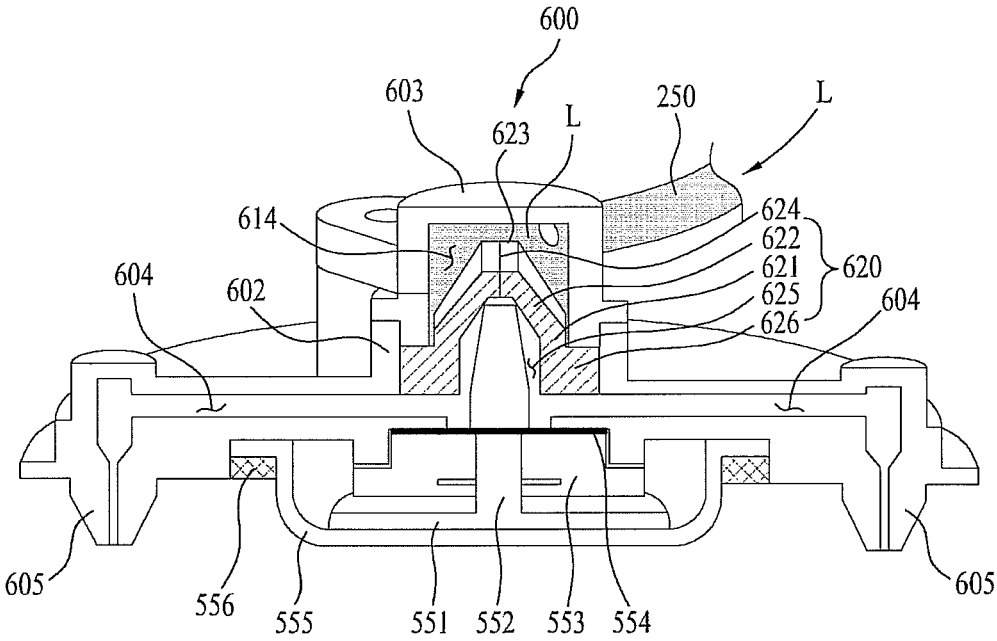
FIG. 15 is a side sectional view illustrating a status of a liquid before exhausted from the liquid exhaustion part according to the second embodiment.

As shown in FIG. 15 in the second embodiment, when the movable member 620 is not pressing to the opening/closing member 620 because the force transmitting device 550 may not be lifting the movable member 630, the appearance of the opening/closing member 620 may be maintained in the initial status.

As a result, the close status of the slit portion 624 may be maintained.

When the closed status of the slit portion 624 is maintained, the liquid (L) drawn into the inlet passage 614 along the guide of the guide pipe 250 may not move toward the outlet 625 of the opening/closing member 620 and the outlet passage 604, with being located in the inlet passage 614.

Figure 16:
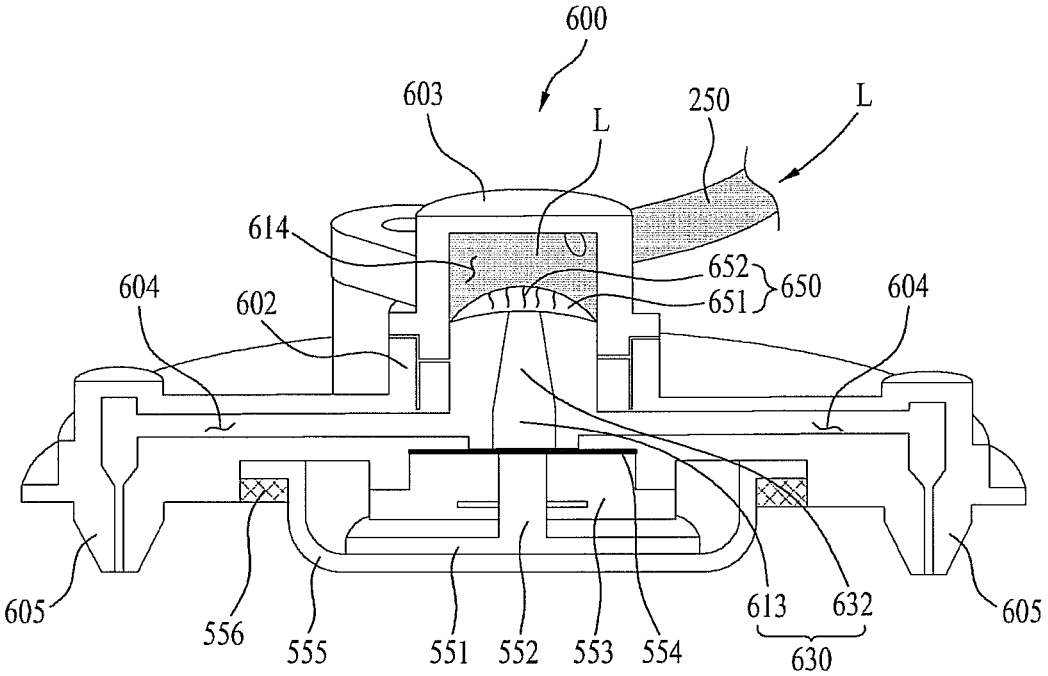
FIG. 16 is a side sectional view illustrating a status of a liquid before exhausted from the liquid exhaustion part according to the third embodiment.

As shown in FIG. 16 in the third embodiment, when the movable member 630 does not apply the force to the opening/closing member 650 because the force transmitting device 550 is not lifting the movable member 630, the appearance of the opening/closing member 650 may be maintained.

As a result, the closed status of the slit portion 652 may be maintained.

When the closed status of the slit portion 652 is maintained, the liquid (L) drawn into the inlet passage 614 along the guide of the guide pipe 250 may not move toward the lower area of the opening/closing member 650 and the outlet passage 604, with being located in the inlet passage 614.

Figure 17:
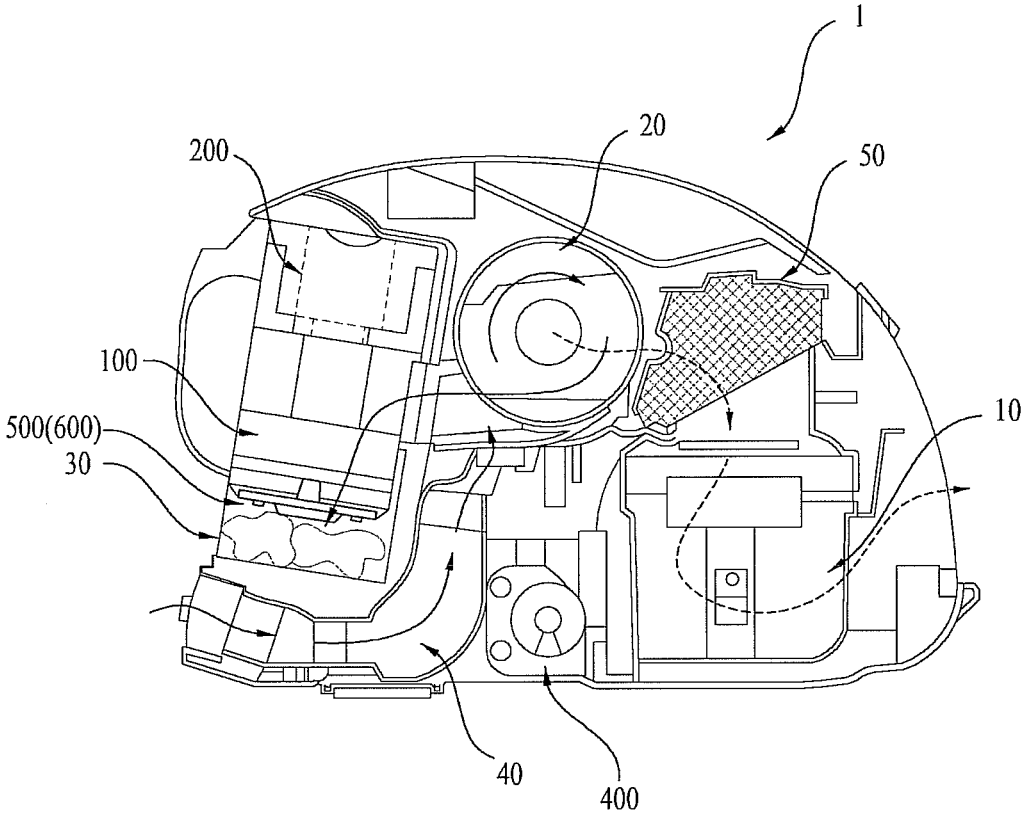
FIG. 17 is a diagram illustrating a status of the dust compressed while collected in the body.

In the meanwhile, as shown in FIG. 17, when the dust compression part 100 is in communication with the outlet of the vacuum motor 10 (the high pressure part) by the switching device 400 in a status of the dust collected in the dust collection device 30, the dust compression part 100 may be expanding and the bottom surface of the dust compression part 100 may be moving toward the bottom surface of the dust collection device 30.

As a result, the liquid exhaustion part 500 and 600 provided in the bottom of the dust compression part 100 may compress the dust, simultaneously with exhausting the liquid toward the dust mass as pressed by the repulsive power from the dust mass.

Figure 18:
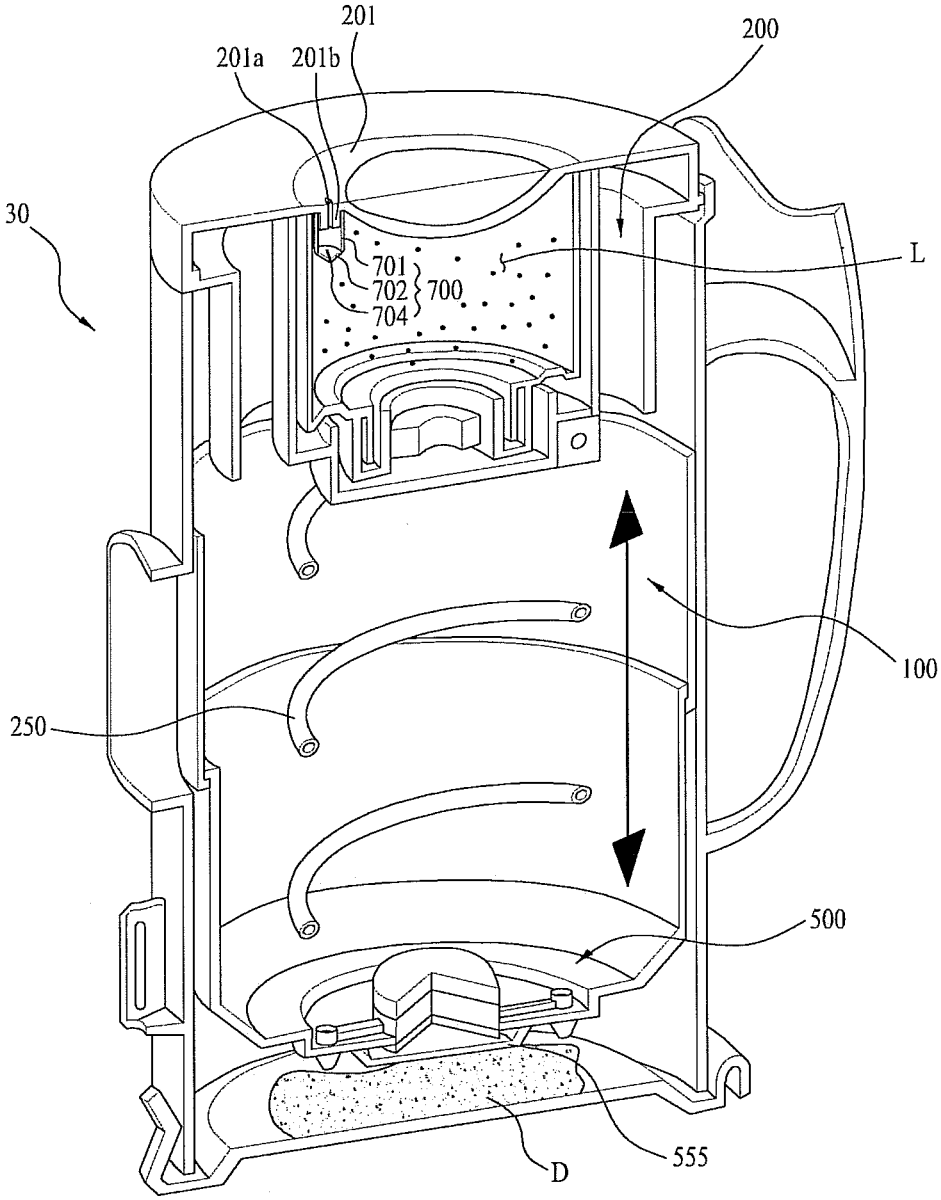
FIG. 18 is a perspective view illustrating a status of dust compression in the dust collection device.

As shown in FIG. 18, the bottom surface of the dust compression part 100 is moving toward the bottom surface of the dust collection device 30 and the collected dust (D) may be then pressed.

The guide pipe 250 may be a coil type. Because of that, the guide pipe 250 may connect the liquid accommodation part 200 with the liquid exhaustion part 500 and 600 constantly as the arranged height of the guide pipe 250 is increasing. The liquid of the liquid accommodation part 200 may be guided to the liquid exhaustion part 500 and 600.

At this time, the compressed dust (D) may be a mass and the dust mass may press the cover member 555 of the liquid exhaustion part 500 and 600.

This is because the compressed dust mass (D) may provide the repulsive power toward the liquid exhaustion part 500 and 600 according to a law of action and reaction.

Figure 19:
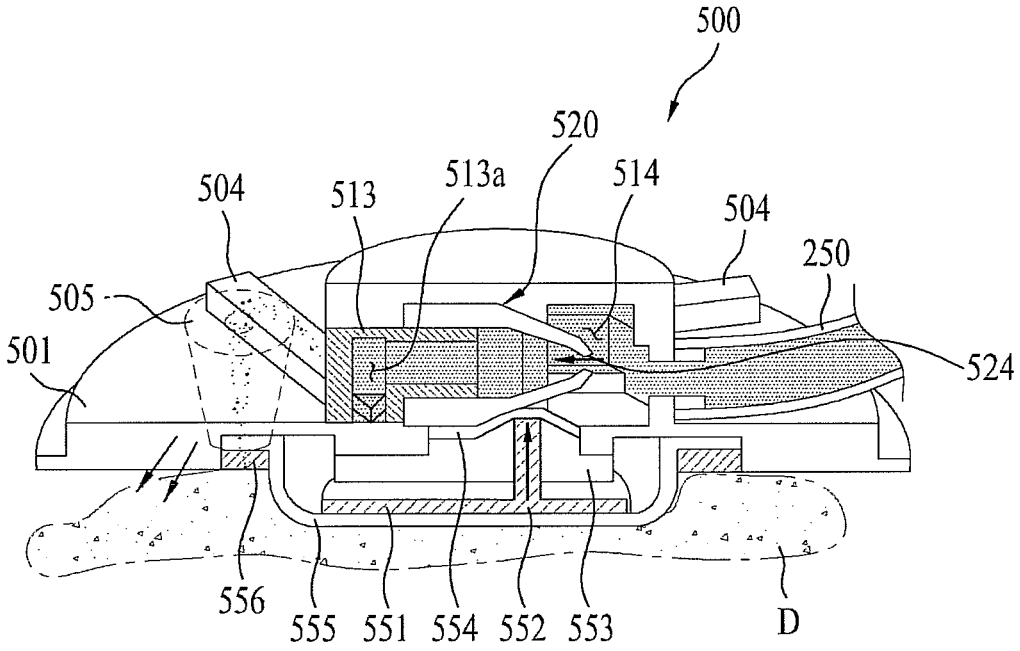
FIG. 19 is a side sectional view illustrating a status of liquid exhaustion in the liquid exhaustion part according to the first embodiment.

As shown in FIG. 19 in the first embodiment, the bottom surface of the dust compression part 100 compress the dust in contact by the expansion of the dust compression part (100, see FIG. 18), the compressed dust mass (D) may contact with the cover member 555.

As the dust compression part 100 is moving downward, the compressed dust mass (D) may lift the cover member 555 upward and both of the movable plate 551 and the force transmitting member 552 may be moved upward.

The upper end of the force transmitting member 552 moving upward may be in contact with the lower surface of the sealing member 554 and the surface of the opening/closing member 520 may be in contact with the upper surface of the sealing member 554.

As a result, when the force transmitting member 552 is moving upward, the sealing member 554 may soar as high as the distance of the upward movement and the opening/closing member 520 may be transformed as receiving the power.

When the opening/closing member 520 is transformed, the slit portion 524 is open and the liquid (L) located in the inlet passage 514 may be drawn through the slit portion 524.

The liquid (L) after passing the slit portion 524 may be drawn into the opening/closing member 520 and it may pass the passage part 513*a*, to be dispersedly flow to each of the outlet passages 504.

The liquid (L) having passed the outlet passage 504 may be exhausted via the outlet nozzle 505, to be sprayed toward the compressed dust mass (D).

When the compressed dust mass (D) is solidified after mixed with the liquid (L), the dust may be prevented from rising away during the cleaning of the dust collection device 30.

In the meanwhile, when the contact between the dust mass (D) and the cover member 555 is removed by the lifted dust compression part 100, the force pressing the opening/closing member 520 may be removed and the appearance of the opening/closing member 520 may be restituted.

Hence, the slit portion 524 may be re-closed as shown in FIG. 14 and the liquid may be stopped from flowing toward the outlet passage 504.

Figure 20:
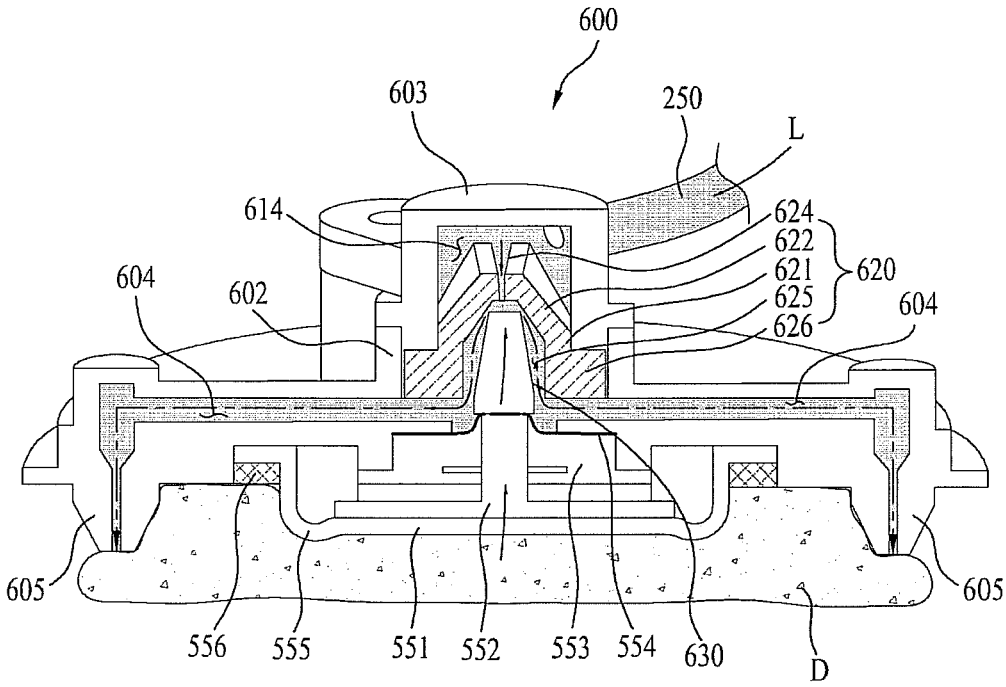
FIG. 20 is a side sectional view illustrating liquid exhaustion in the liquid exhaustion part according to the second embodiment.

As shown in FIG. 20, even in the second embodiment, the bottom surface of the dust compression part 100 may be in contact with the dust by the expansion of the dust compression part (100, see FIG. 18) and the dust may be compressed because of that. After that, the compressed dust mass (D) may be in contact with the cover member 555.

When the cover member 55 is lifted by the compressed dust mass (D) along the downward movement of the dust compression part 100, the movable plate 551 and the force transmitting member 552 may be moved upward.

The upper end of the upward moving force transmitting member 552 may be in contact with the lower surface of the sealing member 554 and the lower end of the movable member 630 may be in contact with the upper surface of the sealing member 554.

The upper end of the movable member 630 may be in contact with an inner surface of the slope portion 622 provided in the opening/closing member 620.

As a result, when the force transmitting member 552 is moved upward, the sealing member 554 may soar as high as the distance of the upward movement and also the movable member 620 may soar as well.

As a result, the opening/closing member 620 may be transformed by the power transmitted by the movable member 620.

When the opening/closing member 620 is transformed, the slit portion 624 may be opened and the liquid (L) received in the inlet outlet 614 may be drawn via the slit portion 624.

The liquid (L) passing the slit portion 624 may be drawn into the opening/closing member 620 and the liquid (L) may be dispersedly supplied to each of the outlet passages 604 via the outlet 625 of the opening/closing member 620.

After passing the outlet passage 604, the liquid (L) may be exhausted from the outlet nozzle 605 and it may be sprayed toward the compressed dust mass (D).

The compressed dust mass (D) may be mixed with the liquid (L) to be solidified and the dust may be prevented from rising away during the cleaning of the dust collection device 30 after that.

In the meanwhile, when the contact between the dust mass (D) and the cover member 555 is removed by the lifting of the dust compression part 100, the force pressing the opening/closing member 620 may be removed and the appearance of the opening/closing member 620 may be restituted accordingly.

As a result, the slit portion 624 may be re-closed as shown in FIG. 15 and the liquid (L) may be prevented from moving into the outlet passage 604.

Figure 21:
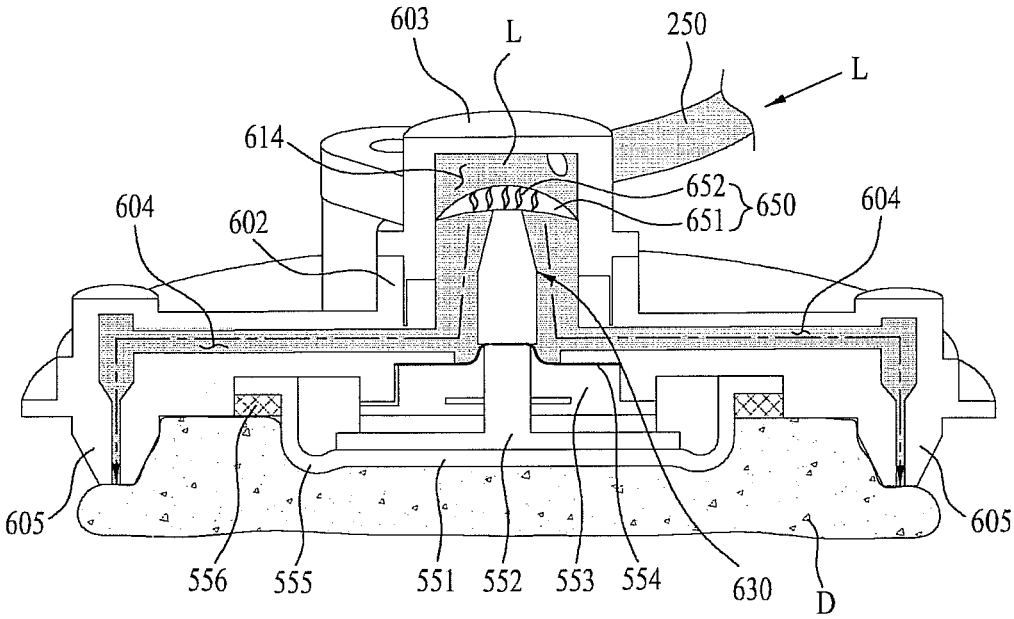
FIG. 21 is a side sectional view illustrating liquid exhaustion in the liquid exhaustion part according to the third embodiment.

As shown in FIG. 21 even in the third embodiment, when the bottom surface of the dust compression part 100 may compress the dust in contact by the expansion of the dust compression part (100, see FIG. 18), the compressed dust mass (D) may be in contact with the cover member 555.

When the compressed dust mass (D) lifts the cover member 555 along the descending of the dust compression part 100, the movable plate 551 and the force transmitting member 552 may be moved upward.

The upper end of the force transmitting member 552 moving upward may be in contact with the lower surface of the sealing member 554 and the lower end of the movable member 630 may be in contact with the top surface of the sealing member 554.

The upper end of the movable member 630 may be in contact with the lower surface of the opening/closing member 650.

As a result, when the force transmitting member 552 is moved upward, the sealing member 554 may soar as high as the distance of the upward movement and the movable member 620 also may soar.

Because of that, the contact area between the opening/closing member 650 and the movable member 620 may soar by the force transmitted from the movable member 620, only to transform the opening/closing member 650. After that, a surface area of the opening/closing member 650 may be increased enough to open the slit portion 652.

When the slit portion 652 is wide to be open, the liquid (L) received in the inlet passage 614 may be drawn via the slit portion 652.

After passing the slit portion 652, the liquid (L) may pass the lower space of the opening/closing member 650 and it may be dispersedly flowing to each of the outlet passages 604.

The liquid (L) having passed the outlet passes 604 may be exhausted from the outlet nozzle 605, to be sprayed toward the compressed dust mass (D).

The compressed dust mass (D) may be mixed with the liquid (L) to be solidified. After that, the dust may be prevented from rising away during the cleaning of the dust collection device 30.

In the meanwhile, when the contact between the dust mass (D) and the cover member 555 is removed by lifting the dust compression part 100, the force pressing the opening/closing member 650 may be removed and the appearance of the opening/closing member 650 may be restituted.

As a result, the slit portion 652 may be re-closed as shown in FIG. 16 and the liquid (L) may be prevented from flowing into the outlet passage 604.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments. Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A vacuum cleaner comprising:

a dust separation device provided in a body;

a dust collection device connected with the dust separation device;

a dust compression part movably provided in the dust collection device, to compress dust by applying a pressure to dust collected in the dust collection device selectively;

a liquid accommodation part provided in the dust collection device or the body, to accommodate a predetermined liquid; and a liquid exhaustion part connected with the liquid accommodation part, to exhaust the liquid toward the dust in the dust compression performed by the dust compression part, wherein the liquid exhaustion part comprises an opening/closing member provided therein to control flow of the liquid, and the opening/closing member is transformed by an external force to guide the liquid to be exhausted outside the liquid exhaustion part, and wherein the opening/closing member is a check valve that is transformed by a pressing force of the dust compressed by the dust compression part, to pass the liquid there through, and that is restituted when the pressing force is removed, to shut off the flow of the liquid.

2. The vacuum cleaner of claim 1, wherein the liquid exhaustion part comprises, a mounting plate mounted to a bottom surface of the dust compression part; and a force transmitting device provided underneath the mounting plate, and wherein the mounting plate comprises an inlet passage having the liquid drawn therein, with receiving the opening/closing member, and an outlet passage having the liquid exhausted there through, and the force transmitting device is configured to transmit a force generated by the pressing of the compressed dust to the opening/closing member, with being movable upward and downward, to transform the opening/closing member.

3. The vacuum cleaner of claim 2, further comprising:

a sealing member provided between the opening/closing member and the force transmitting device, to partition the opening/closing member from the force transmitting device and to prevent the liquid from moving into the force transmitting device.

4. The vacuum cleaner of claim 2, further comprising:

an outlet nozzle projected downward from a lower surface of the mounting plate, in communication with the outlet passage, to exhaust the liquid.

5. The vacuum cleaner of claim 2, wherein the opening/closing member comprises, a body portion that is elastically transformable, with a hollow portion formed therein;

an outlet formed in a side of the body portion, in communication with the hollow portion; and a slit portion formed at an opposite side of the body portion, to be open when the body portion is transformed.

6. The vacuum cleaner of claim 5, wherein the force transmitting device transforms the opening/closing member by pressing an outer circumferential surface of the opening/closing member.

7. The vacuum cleaner of claim 5, further comprising:

a movable member provided between the force transmitting device and the opening/closing member, with being movable upward and downward, wherein the movable member generates the transformation of the opening/closing member by transmitting the force applied to the force transmitting device, to open and close the slit portion selectively.

8. The vacuum cleaner of claim 7, wherein the movable member is received in the opening/closing member, with an end in contact with an area adjacent to the slit portion and the other end in contact with the force transmitting device.

9. The vacuum cleaner of claim 2, wherein the opening/closing member comprises, a body portion configured of a plate; and a slit portion arranged on the body portion, to be open selectively when the body portion is transformed.

10. The vacuum cleaner of claim 9, further comprising:

a movable member provided between the force transmitting device and the opening/closing member, with being movable upward and downward, and wherein the movable member generates the transformation of the opening/closing member by transmitting the force applied from the force transmitting device to the opening/closing member to open and close the slit portion selectively, and an end of the movable member is in contact with a lower surface of the opening/closing member and the other end is in contact with the force transmitting device.

11. The vacuum cleaner of claim 2, wherein the force transmitting device comprises, a movable plate that is movable upward and downward;

a force transmitting member extended from a top surface of the movable plate, to transmit a force applied to the movable plate to the opening/closing member; and a guide member having the force transmitting member inserted therein, to guide the movement of the force transmitting member; and a cover member configured to cover the movable plate, the force transmitting member and the guide member, to prevent them from being exposed outside.

12. The vacuum cleaner of claim 11, wherein the cover member is formed of a flexible material, and a rim of the cover member is connected with a lower surface of the mounting plate to cover the movable plate, the force transmitting member and the guide member.

13. The vacuum cleaner of claim 2, further comprising:

a receiving part coupled to a top surface of the mounting plate to accommodate the liquid received in the liquid accommodation part, with the inlet passage formed therein, and the outlet passage is branched from the receiving part.

14. The vacuum cleaner of claim 1, further comprising:

a vacuum motor provided in the body, to form a vacuum pressure; and a switching device configured to selectively communicate the dust compression part with a high pressure part having a higher pressure than a pressure inside the dust collection device or a low pressure part having a lower pressure than the pressure inside the dust collection device, and the length of the dust compression part is increased when communicating with the high pressure part and the length is decreased when communicating with the high pressure part.

15. The vacuum cleaner of claim 1, wherein the dust compression part may be extendible or contractible upward and downward in the dust collection device, and the liquid accommodation part is provided in the dust compression part, and the liquid accommodation part is coupled to a bottom surface of the dust compression part, with being exposed partially, to exhaust the liquid downward in the dust compression of the dust compression part, lower than the bottom surface of the dust compression part.

16. The vacuum cleaner of claim 1, further comprising:

a guide pipe provided in the dust compression part, with connecting the liquid exhaustion part with the liquid accommodation part, to guide the liquid accommodated in the liquid accommodation part toward the liquid exhaustion part.

17. The vacuum cleaner of claim 16, wherein the guide pipe is a coil type.

18. A vacuum cleaner comprising:

a vacuum motor;

a dust collection device configured to collect dust;

a dust compression part provided in the dust collection device, to be able to communicate with the vacuum motor, the dust compression part that is transformable based on change of a pressure generated by the vacuum motor to compress the dust collected in the dust collection device;

a liquid accommodation part configured to accommodate a liquid that will be mixed with the dust collected in the dust collection device; and a liquid exhaustion part connected with the liquid accommodation part, with being coupled to a contact area of the dust compression part with the dust, to exhaust the liquid toward the dust while contacting with the compressed dust in the dust compression performed by the dust compression part, wherein the liquid exhaustion part comprises, an opening/closing member provided in the liquid exhaustion part to be open selectively during the dust compression to guide flow of the liquid; and a force transmitting device provided in the liquid exhaustion part to be able to contact with the dust, the force transmitting device movable along the contact with the dust compressed in the dust compression to apply a pressure to the opening/closing member.

19. The vacuum cleaner of claim 18, wherein the opening/closing member is fixed within the liquid exhaustion part, and the liquid exhaustion part comprises, a body portion formed of a flexible material;

a slit portion that is open when the body portion is transformed to pass the liquid there through and that is closed when the transformation finishes, to shut off the flow of the liquid.

* * * * *